US005354138A

United States Patent [19]

Daggs

[11] Patent Number: 5,354,138

[45] Date of Patent: Oct. 11, 1994

[54] SELF ADJUSTING, LOW TORQUE RIBBON DRIVE SYSTEM

[75] Inventor: Robert W. Daggs, Simi Valley, Calif.

[73] Assignee: General Ribbon Corporation, Chatsworth, Calif.

[21] Appl. No.: 15,342

[22] Filed: Feb. 9, 1993

Related U.S. Application Data

[63] Continuation-in-part of Ser. No. 989,339, Dec. 11, 1992, abandoned, which is a continuation-in-part of Ser. No. 985,002, Dec. 2, 1992, abandoned.

[51] Int. Cl.[5] ..... B41J 33/24

[52] U.S. Cl. ..... 400/223; 400/228; 400/235

[58] Field of Search ..... 400/196.1, 223, 228, 400/235, 235.1

[56] References Cited

U.S. PATENT DOCUMENTS

| | | | |
|---|---|---|---|
| 4,213,716 | 7/1980 | Carson et al. | 400/235.1 |
| 4,351,619 | 9/1982 | Duke et al. | 400/208 |
| 4,523,868 | 6/1985 | Shadwick | 400/208 |
| 4,552,473 | 11/1985 | Pawlak | 400/208 |
| 4,747,711 | 5/1986 | Motta et al. | 400/208 |
| 5,114,254 | 5/1992 | Sato et al. | 400/207 |

*Primary Examiner*—Edgar S. Burr
*Assistant Examiner*—John S. Hilten
*Attorney, Agent, or Firm*—Baker, Maxham, Jester & Meador

[57] ABSTRACT

An improved ribbon cartridge has an endless printing ribbon and a ribbon inlet and outlet through which a portion of the printing ribbon is fed outside the cartridge for use by a printing device in a printing operation. The ribbon cartridge includes a self adjusting, low torque ribbon drive system, and more particularly, a gear system having a drive gear and one or more idler gears arranged in intermeshing engagement. Each of the gears has a compound curvilinear tooth configuration including one or more ribbon engagement ribs. At least one of the gears may be slideably mounted in the ribbon cartridge for positioning relative to an adjacent intermeshing gear in response to tension on the ribbon.

10 Claims, 4 Drawing Sheets

SELF ADJUSTING, LOW TORQUE RIBBON DRIVE SYSTEM

RELATED APPLICATIONS

The present application is a continuation-in-part of application Ser. No. 07/989,339 filed Dec. 11, 1992, now abandoned, which is a continuation-in-part of application Ser. No. 07/985,002, filed Dec. 2, 1992, now abandoned, having the same inventor.

BACKGROUND OF THE INVENTION

The present invention is directed to the use of ribbons and tapes as a source of ink or other fluid for typing and printing, wherein images are formed (and removed ) by impressing a type on a sheet of paper through the medium of the ribbon or tape. More particularly, the invention pertains to a cartridge for use in an impact printing device that stores a quantity of fluid impregnated ribbon or tape, and in addition, feeds the ribbon or tape through the printing device as new characters are typed so that a fresh supply of the fluid is maintained. Still more particularly, the invention relates to an improved cartridge drive system for feeding a ribbon or tape through a cartridge during a printing operation.

It is common in impact printing to use a ribbon or tape impregnated with ink, correction fluid or the like to form and remove images on a sheet of paper by striking or impacting the paper with a type character through the medium of the ribbon or tape. In the impact printing art, the term "ribbon" is commonly used to describe an ink-bearing medium whereas the term "tape" is often used to denote media containing a correction fluid for removing or covering a previously typed character. For convenience, the term "ribbon" will be used throughout this document as including both ribbon and tape as defined above.

Most ribbon cartridges for impact printing use a gear drive system to continuously feed ribbon through the printing device in which the cartridge is installed. A drive gear in the cartridge is positioned to engage a drive mechanism on the printer, which rotates continuously, or as each character is printed, depending on printer design. This rotation causes the drive gear and an associated intermeshing idler gear to rotate, which pulls the ribbon through the cartridge. The ribbon is usually formed as a continuous loop, the bulk of which is stored in a fan-folded or random arrangement known as a "fabric pack" in a ribbon chamber within the cartridge. From the ribbon chamber, the ribbon feeds through a ribbon outlet, past a print head, and through a ribbon inlet to return to the ribbon chamber.

In order to feed ribbon through the cartridge, the gear drive system must pull the ribbon from the ribbon outlet, draw it into the ribbon inlet, and discharge it into the ribbon chamber. This operation should require only minimal mechanical torque in order to reduce ribbon web tension and avoid imposing excessive power or mechanical demands on the printing device. Moreover, the drive gear system must be capable of accommodating momentary increases in ribbon tension caused when the ribbon fabric becomes partially trapped within the ribbon chamber. This often results from a "buried loop", which is caused when one partial loop of the ribbon fabric is trapped between the side wall of the cartridge and the fabric pack or within the pack itself. Excessive ribbon tension resulting from a buried loop can cause the ribbon to slip between the gears. Such "stalling" can cause either light and dark print or even cartridge or printer failure.

Prior art ribbon cartridges commonly use either a fixed gear drive system or a spring loaded gear system. In a fixed gear system a pair of spur gears frequently having deep, large teeth are used to pull the ribbon. One of the gears is the drive gear and the other gear is an intermeshing idler gear. Both are mounted on fixed rotational axes, typically holes in the top and bottom of the cartridge. A disadvantage of fixed gear systems is that the spacing between the gear axes cannot be precisely controlled due to manufacturing tolerances inherent in molded plastic components. This can cause wide swings in performance between the extremes of binding with high torque (causing possible machine damage or stalling) and fabric slippage resulting in light/dark print.

In a spring loaded gear system the drive gear is rotatably mounted in a fixed axis while an intermeshing idler gear is slideably mounted to allow lateral displacement of the idler gear rotational axis toward the drive gear axis. Uniform drive torque is maintained by resiliently biasing the idler gear toward the drive gear using a spring loading system. A disadvantage of the spring loaded gear system is that more parts are required, which increases the cost of labor and materials, and adds more tolerances for potential variances. In addition, a higher drive torque is generated by the spring force required to maintain desired traction on the ribbon fabric. Spring loaded gear systems also allow backward rotation of the gears unless an additional ratchet is utilized to allow one-way rotation only. Reverse manual rotation frequently results in jams or failure of the system.

In view of the foregoing, there is an evident and presently unfulfilled need in the art for a ribbon cartridge and ribbon drive system that overcomes the problems and disadvantages of previous designs, including, in particular, the problems of excessive drive torque and undesirable drive slippage under high load conditions.

SUMMARY OF THE INVENTION

The present invention relates to an improved ribbon cartridge having a endless printing ribbon and a ribbon inlet and outlet through which a portion of the printing ribbon is fed outside the cartridge for use by a printing device in a printing operation. The ribbon cartridge includes a low torque, high traction ribbon drive system. In a preferred aspect of the invention, the ribbon drive system includes a gear system formed by a drive gear and one or more idler gears arranged in intermeshing engagement. Each of the gears has a compound curvilinear tooth configuration including one or more ribbon engagement ribs to provide enhanced ribbon pulling traction and reduced drive torque. To further increase ribbon drive traction in response to excess ribbon web tension, at least one of the gears may be slideably mounted in the ribbon cartridge and positioned in the ribbon path so as to be driven toward an adjacent intermeshing gear by the ribbon itself or rotationally pulled together. In this way, the contact force between the gears, and hence the ribbon traction, is primarily a function of ribbon web tension.

BRIEF DESCRIPTION OF THE DRAWINGS

The objects, advantages and features of the present invention will be more clearly understood by reference to the following detailed disclosure and the accompanying drawing in which.

DETAILED DESCRIPTION OF THE PREFERRED EMBODIMENTS

Figure 1:
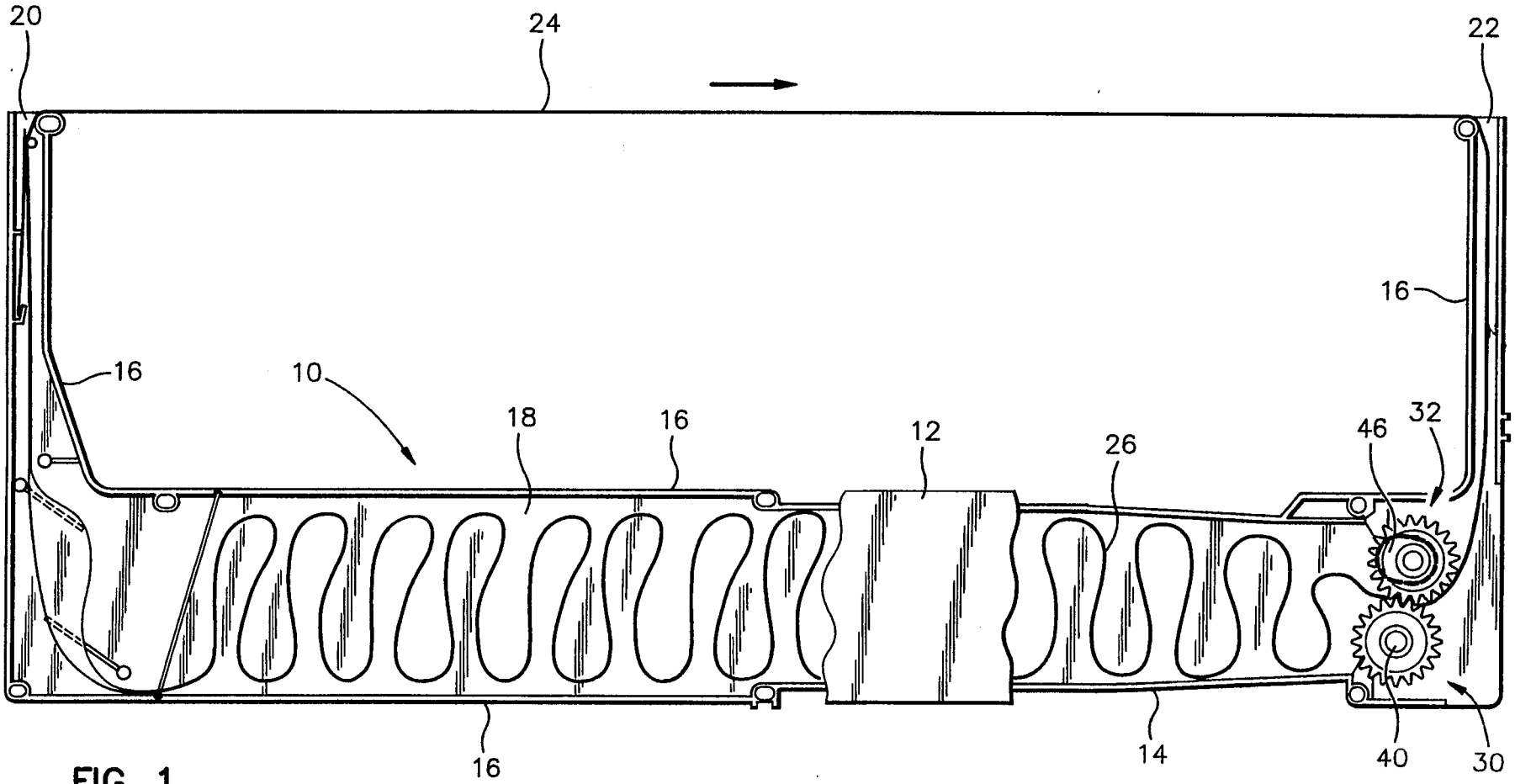
FIG. 1 is a plan view of the interior of a ribbon cartridge constructed in accordance with the present invention, with the cartridge in a normal operating mode.

Referring now to FIG. 1, a ribbon cartridge and self adjusting, low torque ribbon drive system includes a housing 10 having a top 12, a bottom 14 and a plurality of side members 16 extending between the top and the bottom. A ribbon chamber 18 is disposed in the housing between a ribbon outlet 20 in communication with a first end of the ribbon chamber, and a ribbon inlet 22 in communication with a second end of the ribbon chamber. An endless ribbon 24 is arranged partially in the housing 10 and partially outside the housing along a ribbon path extending sequentially through the ribbon chamber 18, the ribbon outlet 20, the ribbon inlet 22 and back to the ribbon chamber. Within the ribbon chamber 18, the ribbon 24 is arranged in a semi-fan-folded fabric pack 26.

Figure 2:
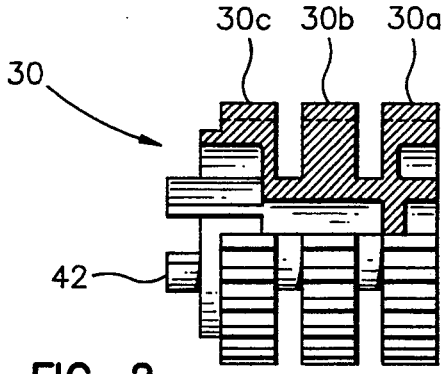
FIG. 2 is an elevational side view of a drive gear in the ribbon cartridge of FIG. 1.
Figure 3:
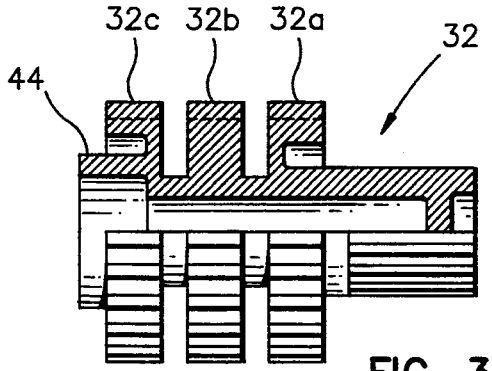
FIG. 3 is an elevational side view of an idler gear in the ribbon cartridge of FIG. 1.

A gear system is disposed in the housing 10 for driving the ribbon 24 along the ribbon path. The gear system has a plurality of spur gears including a drive gear 30 and an idler gear 32 arranged in intermeshing engagement. As shown in FIGS. 2 and 3 each of the gears 30 and 32 may include a plurality of gear faces 30*a–c* and 32*a–c*, respectively. As shown in FIG. 4, each gear face has a compound curvilinear tooth configuration. This curvilinear configuration can be formed in a variety of shapes including a sinusoidal or other curved formation that imparts rolling forces on the ribbon rather than shearing forces. In a preferred aspect of the invention, the gear tooth configuration is defined by a plurality of generally semicircular teeth 34 separated by opposing, generally semicircular gaps 36. The drive gear 30 and the idler gear 32 further include a secondary tooth configuration providing a compound gear tooth curvature. The secondary gear teeth are defined by a plurality of lobes or ribs 38 arranged about the radii of each primary gear tooth 34. Each primary gear tooth 34 preferably includes at least two such ribs or may include three ribs as shown in FIG. 4. As shown, the ribs 38 are oriented to extend generally radially from the outer surface of each primary tooth.

Figure 4A:
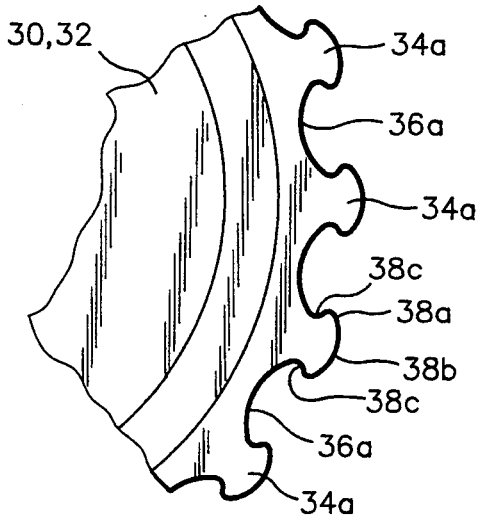
FIG. 4*a* is a partial detailed plan view of a drive or idler gear constructed in accordance with another embodiment of the invention.
Figure 4:
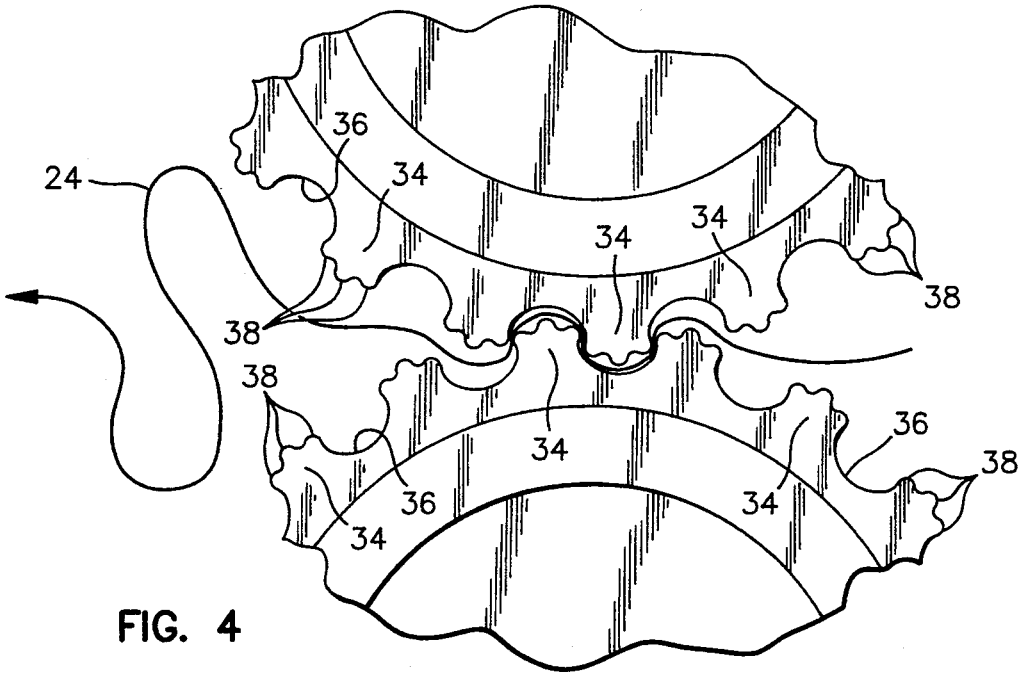
FIG. 4 is a detailed partial plan view of the tooth configuration of the drive and idler gears of FIGS. 2 and 3.

FIG. 4*a* illustrates another preferred aspect of the invention wherein the compound curvilinear gear tooth configuration is defined by a plurality of generally semicircular teeth 34*a* separated by opposing, generally semicircular gaps 36*a*. The tooth configuration of FIG. 4*a* is similar to that of FIG. 4 except that the secondary gear tooth configuration 38*a* includes a single lobe or rib 38*b*, forming a pair of undercuts or rims 38*c* in the sides of the primary gear tooth 34*a*. The undercuts 38*c* are identical to the undercuts provided by the outside edges of the outer ribs 38 shown in FIG. 4. Thus the gear tooth configuration of FIG. 4*a* has the same ribbon drive traction characteristics as the gear teeth of FIG. 4. More particularly, it appears that the undercuts formed by the ribs 38 and 38*c*, when engaged with corrresponding undercuts in an opposing gear, form pinch points that temporarily grasp or pinch the ribbon using high contact pressure as it passes between the gears.

Figure 5:
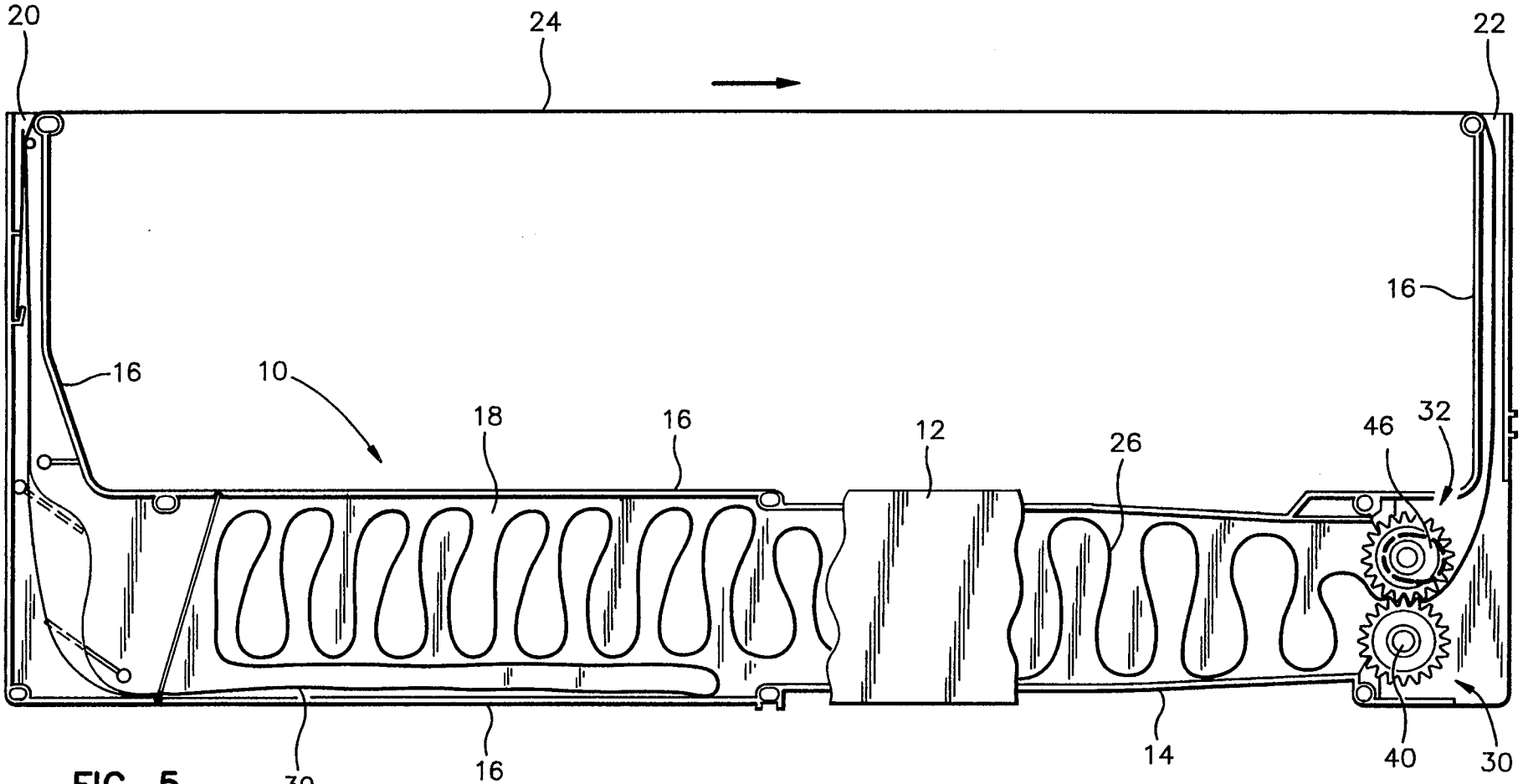
FIG. 5 is a plan view of the interior of the ribbon cartridge of FIG. 1, with increased ribbon web tension creating a wedged gear mode.

As shown in FIG. 1, at least one of the gears 30 and 32 is preferably slideably mounted in the housing 10 for positioning relative to the adjacent intermeshing gear which is mounted on a fixed rotational axis. This configuration assists in limiting ribbon slippage during temporary increases in web tension. As indicated, such increases can be caused by a buried loop such as the loop 39 shown in FIG. 5.

Figure 6:
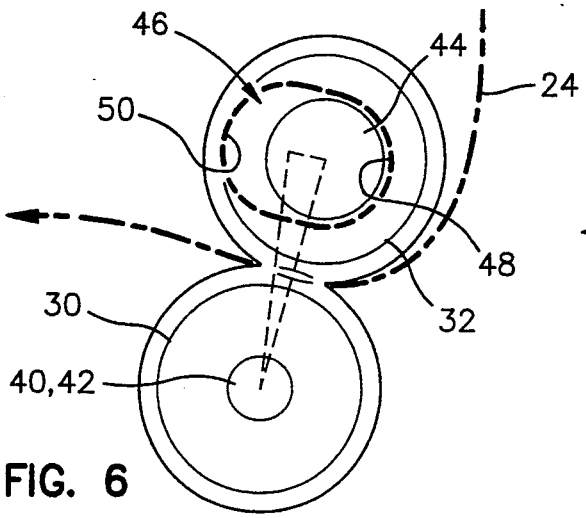
FIG. 6 is a detailed plan view of the drive and idler gears of FIGS. 2 and 3 during normal cartridge operation.
Figure 7:
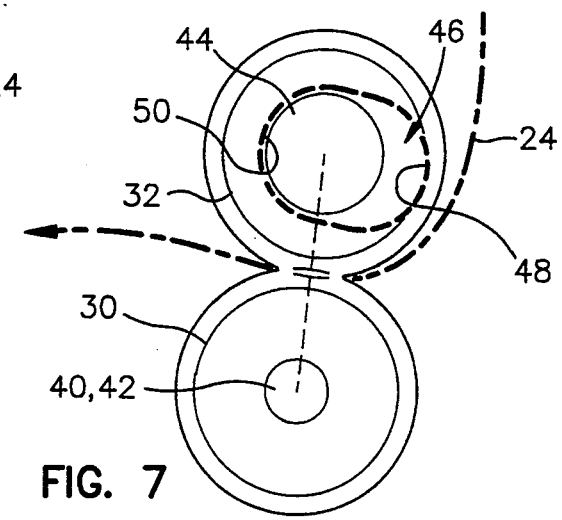
FIG. 7 is a detailed plan view of the drive and idler gears of FIGS. 2 and 3 with the cartridge in a wedged gear mode.

Turning now to FIGS. 6 and 7, the drive gear 30 is mounted on a fixed rotational axis 40, which is preferably formed by a hole (not shown) in the bottom 14 of the housing 10. The fixed axis hole is sized to receive a hub 42 of the gear 30 (shown in FIG. 2), which in turn is adapted to mate with a drive shaft (not shown) on a printing device in which the ribbon cartridge is mounted. The slideably mounted idler gear 32 includes a hub 44 that is mounted in a slot 46 formed in the housing bottom 14. (A corresponding slot is provided in the housing top 12, but for simplicity is not shown in the figures). The slot 46 has a first end 48 and a second end 50. The first end 48 is positioned further away from the fixed axis 40 than the second end 50. Thus, the slot 46 is oriented so that the distance between the axis of the slot-mounted idler gear 32 and the adjacent intermeshing drive gear 30 changes as the idler gear moves from one end to the other end of the slot 46. Advantageously, the direction and angle of the slot may be selected to maximize cartridge performance in accordance with the operational characteristics desired.

As shown in FIGS. 6 and 7, the ribbon 24 extends around a side of the slot-mounted idler gear 32 closest to the first end 48 of the slot 46, and thereafter between the idler gear 32 and the adjacent intermeshing drive gear 30. In this configuration, it will be appreciated that the idler gear 32 is urged against the drive gear 30 by the force of the ribbon 24 acting on the side of the idler gear. The ribbon drive traction on the gear system is thus a function of web tension in the ribbon. As web tension increases due to a ribbon buried loop, the idler gear 32 is urged toward the drive gear 30 to decrease the distance between the gears and increase the drive traction, as shown in FIG. 7.

The result of this configuration is a drive system having the advantages of low initial drive torque, low initial web tension, and increased ribbon drive traction and resistance to drive slippage. These advantages of a low torque, self adjusting system have been tested and found to provide superior performance when compared to fixed gear systems or spring loaded gear systems, as the values in Table I below indicate:

TABLE I

| DRIVE TYPE | DRIVE TORQUE | WEB TENSION | DRIVE SLIPPAGE THRESHOLD |
|---|---|---|---|
| Fixed Gear | 1.4–2.4 Ncm | 24–62 g | 395 g |
| Spring Load | 1.5–2.6 Ncm | 42–62 g | 295 g |
| Low Torque | 0.5–1.1 Ncm | 18–56 g | 550 g |

In Table I, the fixed gear system tested was an IBM cartridge model 4683, while the spring loaded gear system was a MX80 cartridge made by Epson. These cartridges were tested on a conventional laboratory bench test machine. As Table I illustrates, the nominal drive torque was significantly lower in the self adjusting low torque system. On the other hand, the force threshold at which drive slippage occurred was significantly higher in the low torque system than in the fixed gear and spring loaded cartridges.

Figure 8:
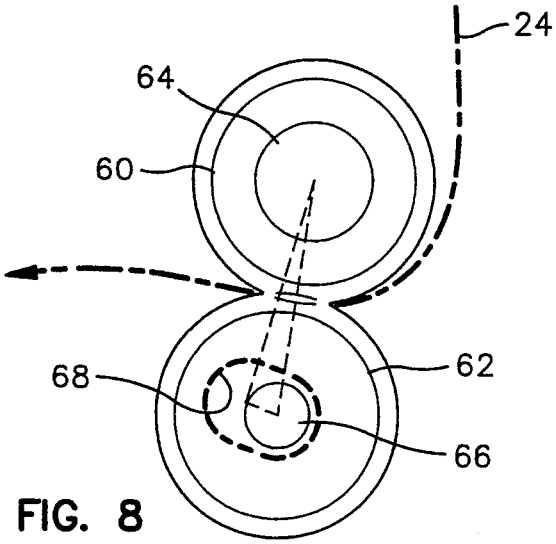
FIG. 8 is a detailed plan view of a drive gear and an idler gear in an alternative construction during normal cartridge operation.
Figure 9:
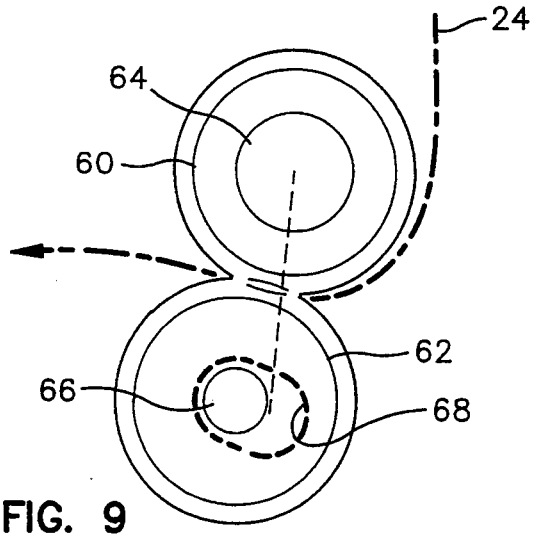
FIG. 9 is a detailed plan view of the drive and idler gears of FIG. 8 with the cartridge in a wedged gear mode.

Referring now to FIGS. 8 and 9, an alternative low torque construction is shown. In this configuration, a drive gear 60 is arranged in intermeshing engagement with an idler gear 62. The drive gear 60 is mounted on a fixed axis 64 while the idler gear 62 has a hub 66 mounted in a slot 68. As ribbon web tension increases due to a ribbon buried loop, the gears are rotationally pulled together such that the idler gear 62 moves from the nominal position shown in FIG. 8 to the position shown in FIG. 9 in which the distance between the drive gear 60 and the idler gear 62 is decreased.

Figure 10:
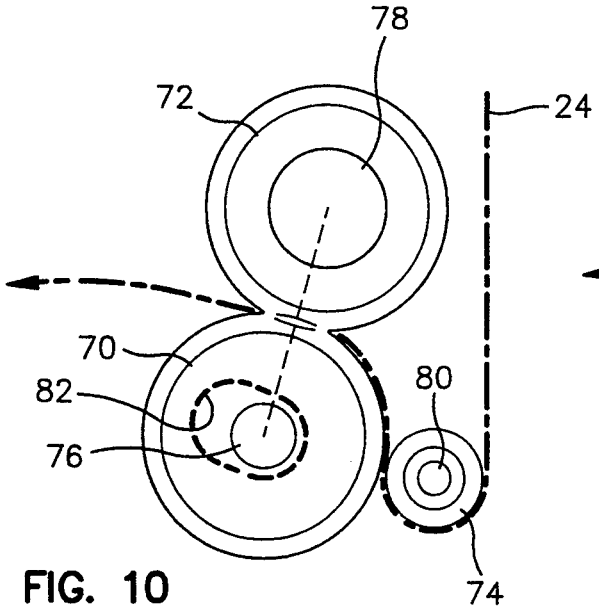
FIG. 10 is a detailed plan view of a drive gear and an idler gear in another alternative construction during normal cartridge operation.
Figure 11:
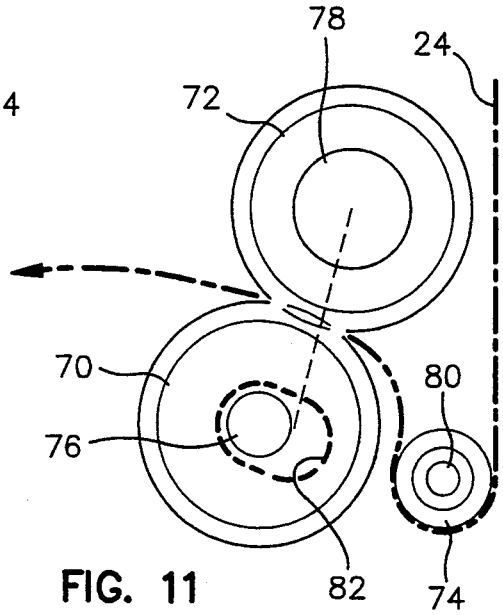
FIG. 11 is a detailed plan view of the drive and idler gears of FIG. 10 with the cartridge in a wedged gear mode.

Referring now to FIGS. 10 and 11, another alternative low torque construction is shown. In this configuration, an idler gear 70 is arranged in intermeshing engagement with a drive gear 72 and a ribbon guide 74 which may be a fixed guide post or a roller. The idler gear 70 includes a hub 76. The drive gear 72 is mounted on a fixed axis 78. The ribbon guide 74 is mounted on a fixed axis 80. The idler gear hub 76 is mounted in a slot 82. As ribbon web tension increases, the idler gear 70 moves from the nominal position shown in FIG. 10 to the position shown in FIG. 11 in which the distance between the idler gear 70 and the drive gear 72 is decreased.

Accordingly, a novel ribbon cartridge with a self adjusting, low torque ribbon drive system has been described. This system requires fewer parts than conventional systems and eliminates manufacturing tolerances as a cause of poor performance or cartridge failures. The drive system is self adjusting and self compensating. This reduces drive torque and provides smoother rotation, better fabric pack and eliminates ribbon slippage. The design also permits a wide range of fabric calipers to be used. Moreover, fabric back tension can be reduced as floating gears equalize fabric tension and cause no puckering of the ribbon fabric during rotation, even with little web tension applied to the fabric or with various calipers of fabric.

The curvilinear gear tooth configuration applies concentrated rolling forces with high contact pressure on the ribbon rather than shearing forces. The ribs or lobes on the gear teeth also cause higher contact pressure on the ribbon fabric to maintain and/or increase pulling traction throughout the 360 degrees of rotation. Preferably, two or more ribs of each gear tooth will always be in contact with the ribbon fabric thus causing pinch points to advance the fabric. The primary and secondary gear teeth can be easily formed in numerous patterns and configurations to adjust the operating forces in the drive system. As indicated, the system operating forces can also be controlled by altering the floating gear slot angle and direction. The floating gear slot further allows the floating gear to cam partly out of proper mesh and lock the gears, preventing manual backward rotation.

While various embodiments of the invention have been disclosed, it is expected that many variations and additional alternative embodiments will be apparent to those skilled in the art in view of the teachings herein. It will be understood, therefore, that the invention is not to be limited except in accordance with the spirit of the appended claims and their equivalents.

I claim:

1. A ribbon cartridge and self adjusting, low torque ribbon drive system, comprising:

a housing having a top, a bottom and a plurality of sides extending between said top and said bottom;

a ribbon chamber disposed in said housing;

a ribbon outlet disposed in said housing in communication with a first end of said ribbon chamber;

a ribbon inlet disposed in said housing in communication with a second end of said ribbon chamber;

an endless ribbon arranged partially in said housing and partially outside said housing along a ribbon path extending sequentially through said chamber, said ribbon outlet, said ribbon inlet and back to said chamber;

a gear system disposed in said housing for driving said ribbon along said ribbon path, said gear system having a plurality of spur gears including a drive gear and an idler gear arranged in intermeshing engagement, each said gear having a compound curvilinear tooth configuration, at least one of said gears being slideably mounted in said housing for positioning relative to an adjacent intermeshing gear in response to tension on said ribbon;

said drive gear and said idler gear each including a primary tooth configuration defined by a plurality of generally semicircular teeth separated by opposing generally semicircular gaps;

said drive gear and said idler gear further having a secondary tooth configuration defined by a plurality of ribs arranged on and extending about radii of each primary gear tooth, each primary tooth of said drive gear and said idler gear including at least one or more such ribs, said ribs being generally radially shaped;

said slideably mounted gear being mounted in a slot in said housing, and an adjacent intermeshing gear being mounted on a fixed axis, said slot having a first end and a second end, said first end being further away from said fixed axis than said second end, said slot being oriented so that the distance between said slot-mounted gear and the adjacent intermeshing gear changes as the slot-mounted gear moves from one end to the other end of said slot;

said ribbon extending around a side of said slot-mounted gear closest to said first end of said slot and thereafter between said slot-mounted gear and the adjacent intermeshing gear.

2. A ribbon cartridge and self-adjusting, low torque ribbon drive system, comprising:

a housing having a top, a bottom and a plurality of sides extending between said top and said bottom;

a ribbon chamber disposed in said housing;

a ribbon outlet disposed in said housing in communication with a first end of said ribbon;

a ribbon inlet disposed in said housing in communication with a second end of said ribbon chamber;

an endless ribbon arranged partially in said housing and partially outside said housing along a ribbon path extending sequentially through said chamber, said ribbon outlet, said ribbon inlet and back to said chamber;

a gear system disposed in said housing for driving said ribbon along said ribbon path, said gear system having a plurality of spur gears including a drive gear and an idler gear arranged in intermeshing engagement, each said gear having a compound curvilinear tooth configuration;

said drive gear and said idler gear each including a primary tooth configuration defined by a plurality of generally semicircular teeth separated by opposing generally semicircular gaps;

said drive gear and said idler gear further having a secondary tooth configuration defined by a plurality of ribs arranged about radii of each primary gear tooth, each primary tooth of said drive gear and said idler gear including at least one or more such ribs, said ribs being generally radially shaped.

3. The ribbon cartridge of claim 2 wherein one of said one or more idler gears is a slot-mounted idler gear that is slideably mounted in a slot in said housing.

4. The ribbon cartridge of claim 3 wherein said slot is oriented so that the distance between the gear mounted therein and an adjacent intermeshing gear changes as the slot-mounted gear moves from one end to the other end of said slot.

5. The ribbon cartridge of claim 3 wherein a gear in intermeshing engagement with said slot-mounted gear is mounted on a fixed axis, and wherein said slot has a first end and a second end, said first end being further away from said fixed axis than said second end.

6. The ribbon cartridge of claim 5 wherein said ribbon extends around a side of said slot-mounted idler gear closest to said first end of said slot and thereafter between said idler gear and an adjacent intermeshing drive gear.

7. The ribbon cartridge of claim 5 wherein said ribbon extends around a side of said drive gear and thereafter between said drive gear and said slot-mounted idler gear.

8. The ribbon cartridge of claim 2 wherein said gear system gears include a drive gear in intermeshing engagement with an idler gear and a ribbon guide adjacent to said idler gear.

9. The ribbon cartridge of claim 8 wherein said drive gear is mounted on a first fixed axis, said ribbon guide is mounted on a second fixed axis, and said idler gear is mounted in a slot in said housing, said slot having a first end and a second end, said first end being further away from said first fixed axis than said second end, and wherein said ribbon extends around said ribbon guide, and thereafter between said drive gear and said idler gear.

10. The ribbon cartridge of claim 2 wherein said ribbon chamber includes a packed arrangement of ribbon and said gears are positioned in said housing to pull ribbon into said housing from said ribbon inlet and direct ribbon into said ribbon chamber.

* * * * *